United States Patent [19]

Siefer

[11] Patent Number: 5,012,578

[45] Date of Patent: May 7, 1991

[54] ONE-PIECE RAZOR WITH HINGED SLIDING CAP

[75] Inventor: David A. Siefer, Orange, Conn.

[73] Assignee: Warner-Lambert Company, Morris Plains, N.J.

[21] Appl. No.: 586,495

[22] Filed: Mar. 5, 1984

[51] Int. Cl.[5] ..... B26B 21/14

[52] U.S. Cl. ..... 30/84; 30/47

[58] Field of Search ..... 30/84, 41, 47, 85; 16/225

[56] References Cited

U.S. PATENT DOCUMENTS

| | | | |
|---|---|---|---|
| 3,154,852 | 11/1964 | Westlake | 30/84 |
| 3,616,487 | 11/1971 | Dearth | 16/225 |
| 3,794,207 | 2/1974 | Hunt | 220/375 |
| 4,328,615 | 5/1982 | Bowman | 30/84 |
| 4,395,822 | 8/1983 | Ciaffone | 30/41 |

*Primary Examiner*—Frank T. Yost
*Assistant Examiner*—Willmon Fridie, Jr.
*Attorney, Agent, or Firm*—Daniel A. Scola, Jr.; Craig M. Bell

[57] ABSTRACT

A disposable plastic razor of the type having a shaving position and a storage position in which all plastic elements of the razor are molded as a single one-piece unit.

10 Claims, 3 Drawing Sheets

ONE-PIECE RAZOR WITH HINGED SLIDING CAP

BACKGROUND OF THE INVENTION

This invention relates to low cost disposable wet shaving razors of the type having a shaving position and a storage position.

Such razors include one or two blades each having a single cutting edge fixed to a blade support. Relative motion between the blade support and a blade cap or cover is effective selectively to expose the blade edge properly for wet shaving in one position or to protect the blade edge for storage in a second position.

Typical examples of wet shaving disposable razors over which the present invention is an improvement and which form a background for this invention are shown and described in U.S. Pat. No. 4,328,615 and U.S. Pat. No. 4,395,822 issued May 11, 1982, and Aug. 2, 1983, to Peter Bowman et al and John T. Ciaffone, respectively, both assigned to Warner-Lambert Company.

In both these disclosures the razor blades is overlaid by a movable cap or cover which is manufactured (molded) as a separate piece-part. The cover makes an interlocking movable connection with a blade support so that the cover is movable relative to the blade support to a first position defining a shaving position to a second position defining a storage or blade edge protected position.

The language "blade" or "blade edge" as used in this specification is intended to denote one or more blades each having a single cutting edge. Obviously where two blades are involved it is necessary to space and offset one blade edge from the other in order to maintain blade geometry for reasons that are well known in the shaving art.

It is a principal feature of the present invention to provide an improved disposable razor which is economical to manufacture.

In particular, it is a feature of the invention to provide a disposable razor where all plastic elements are molded as a single unitary piece-part.

A further feature of the invention is the provision of a disposable razor having a cap which is movable relative to the blade support where the cap is hinged to the blade support.

SUMMARY OF THE INVENTION

A disposable plastic razor embracing certain features of the present invention may comprise a molded plastic blade support, a molded plastic blade cap, said support and cap making an interlocking connection and being movable relative to one another, and molded plastic hinge means connecting the blade cap and the blade support.

Other features and advantages of the present invention will become more apparent from the succeeding specification when read in conjunction with the appended drawings, in which:

DESCRIPTION OF THE PREFERRED EMBODIMENTS

Figure 1:
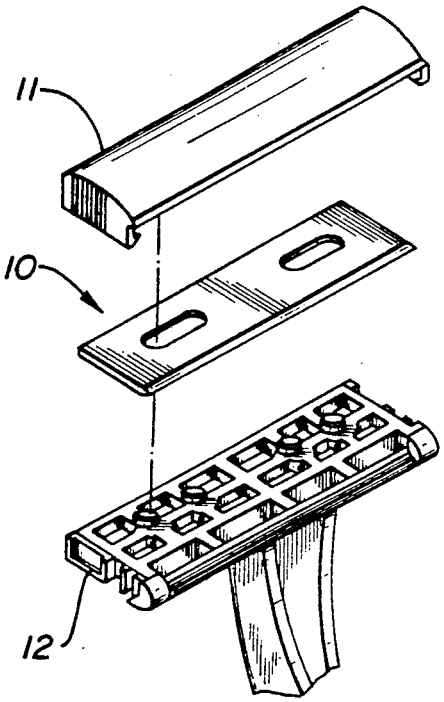
FIG-1 PRIOR ART
FIG. 1 is a representation of the prior art.

Referring now in detail to the drawings, the reference numeral 10 in FIG. 1 shows a prior art razor where the cap 11 is a separately molded piece-part relative to the blade support 12.

Figure 2:
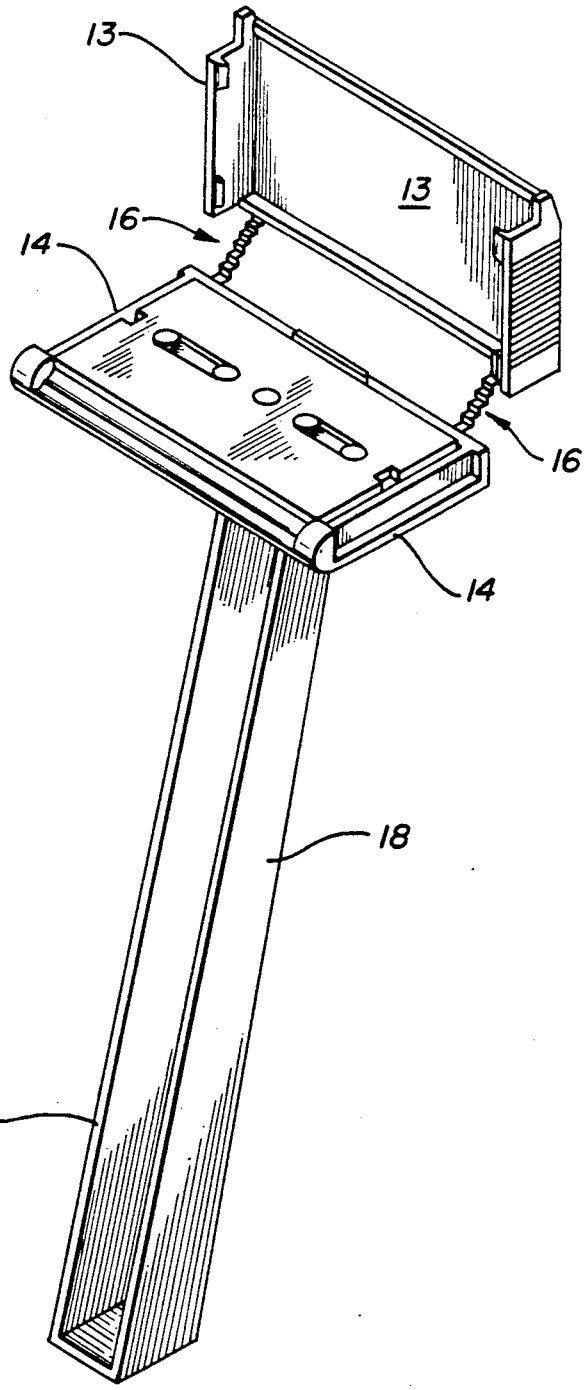
FIG. 2 is a perspective view of a disposable razor showing the hinged cap and blade support assembly.

FIG. 2 shows a similar molded plastic cap 13 connected to a molded plastic blade support 14 where the cap and the support are connected by molded plastic hinge means indicated generally at 16.

The hinge means may take the shape of an extensible ribbon 17 (FIG. 3) of generally corrugated configuration with sufficient capability to enlongate so as to accommodate the desired relative motion necessary to "open" and "close" the razor.

If desired, it is within the scope of the invention to design the hinge in the form of a short thin ribbon having a weakened cross-section or a line of weakness so that upon the assembly of the cap to the blade support with the blade edge exposed motion of the cap to the closed position will operate to separate the ribbon at the line of weakness.

Normally the cap is snapped upon the blade support so that the blade edge is in the shaving position. Thus, movement of the cap to the storage position is effective to tear the thin ribbon at the line of weakness.

Alternatively, the hinge may be relatively brittle to effect a "breakaway" action when the cap is assembled to the blade support. A relatively brittle hinge also operates to maintain the single piece-part (cap and blade support) manageable during the course of assembly operations. With a relatively rigid hinge, the cap does not move about relative to the blade support while handled by automatic machinery.

At this point it should be apparent that the primary benefit in hinging the cap to the blade support resides in convenience of manufacture. That is, one piece-part is much less expensive to handle on the production line than two piece-parts.

In addition, it is entirely within the scope of the present invention that the blade support, hinge and cap be molded as a single unitary piece-part with or without a handle 18.

Figure 3:
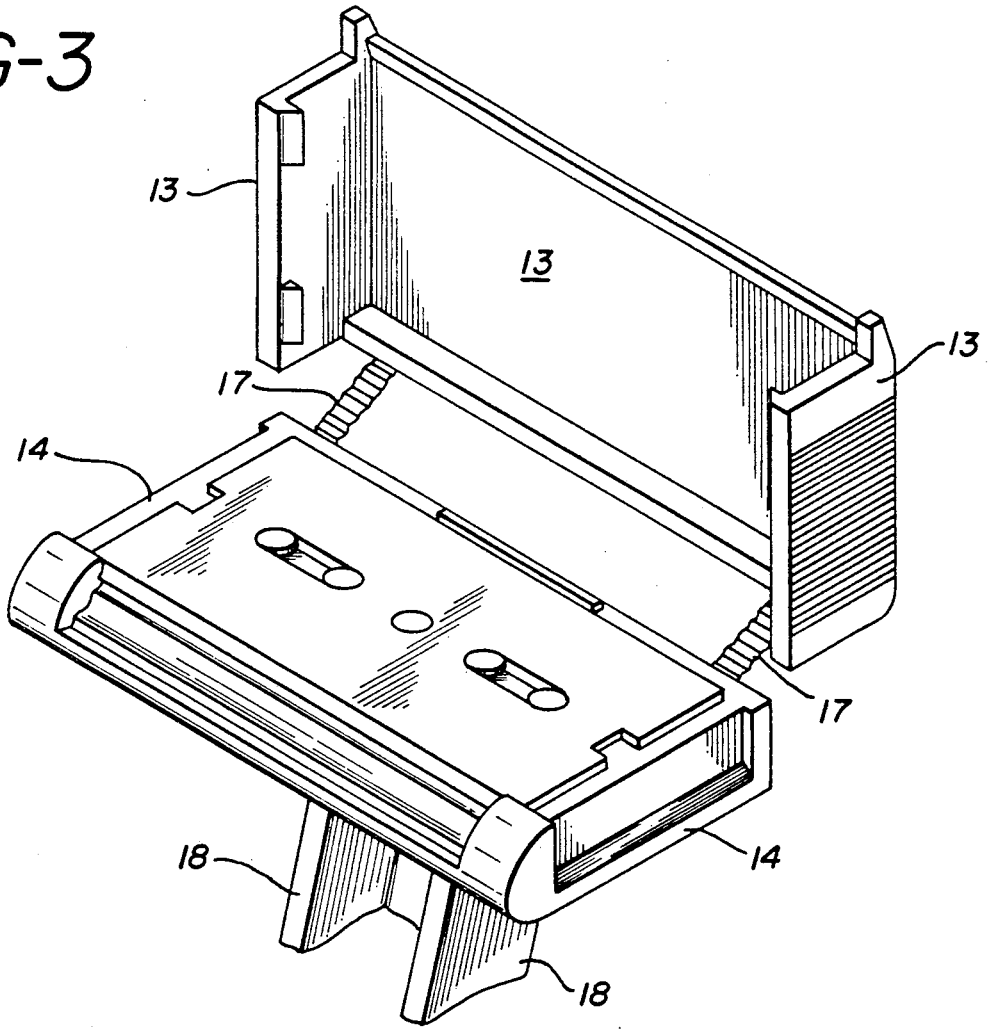
FIG. 3 shows a portion of FIG. 2 enlarged for clarity.
Figure 6:
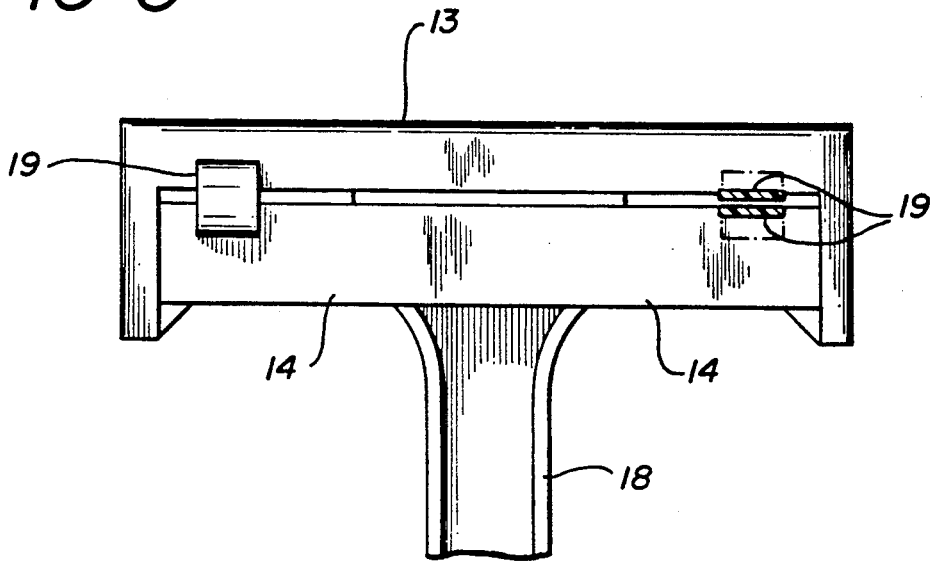
FIG. 6 is an end elevation of FIG. 5 in two different planes.
Figure 4:
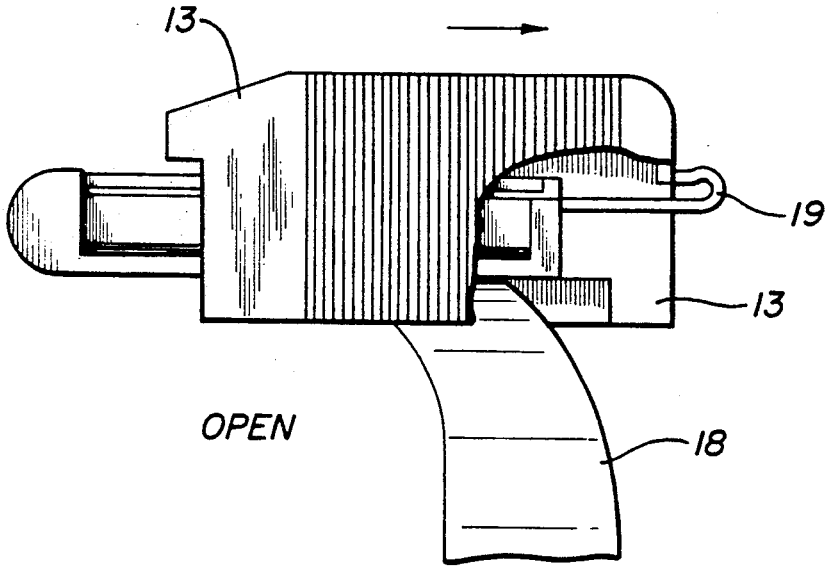
FIG. 4 shows the cap and blade support interlocked with the blade edge exposed (OPEN) properly for wet shaving.
Figure 5:
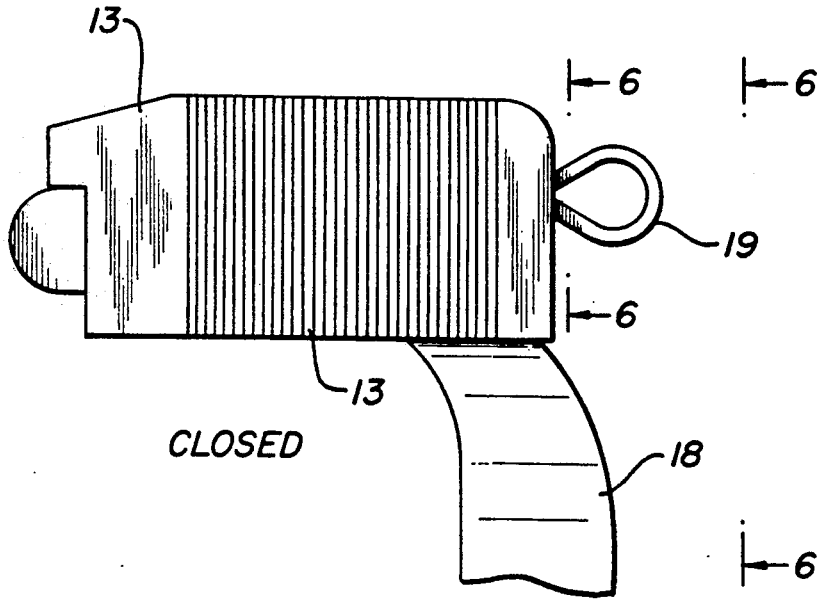
FIG. 5 shows the blade edge in storage or protected (CLOSED)

Furthermore, it is to be recognized that the hinge of FIGS. 3, 4 and 5 is exaggerated in size. Consideration of exterior ornamentation and good tool design should result in a very small, unobtrusive hinge structure.

Note further that a thin web-like hinge 19 (FIGS. 4 and 5) may be devised without a breakaway or weakened line so long as there is sufficient "slack" in the hinge to accommodate the stroke of the blade cap.

It is anticipated that a wide variety of modifications may be devised in this invention without departing from its spirit and scope.

What is claimed is:

1. A disposable razor having at least one blade with a shaving edge, a unitary assembly of a molded plastic blade support for supporting said at least one blade and a molded plastic blade cap covering said blade, said cap and said blade support joined by a web-like molded plastic hinge having a loop formation between said cap and said blade support to allow sliding motion between said cap and said blade support, wherein said hinge is formed with a weakened cross-section operative to separate when said sliding motion occurs and is positioned opposite said shaving edge and allows relative motion between said cap and said support to provide a blade edge protected and a blade edge exposed position by movement of either said cap or said support.

2. The razor of claim 1 in which the one-piece molded plastic assembly includes a molded plastic handle.

3. The razor of claim 1 in which the hinge means defines at least two spaced flexible elements.

4. The razor of claim 1 in which the hinge means is extensible to facilitate relative motion between said movable elements.

5. The razor of claim 1 in which the hinge means defines a thin web.

6. A disposable razor having at least one blade with a shaving edge, a unitary assembly of a molded plastic blade support for supporting said at least one blade and a molded plastic blade cap covering said blade, said cap and said blade support joined by a web-like molded plastic hinge means with a loop formation between said cap and said blade support to allow sliding motion between said cap and said blade support, wherein said hinge means is relatively brittle to facilitate a breakaway action when said sliding motion occurs and is positioned opposite said shaving edge allowing relative motion between said cap and said support to provide a blade edge protected and a blade edge exposed position by movement of either said cap or said support.

7. the razor of claim 6 wherein said one-piece molded plastic assembly includes a molded plastic handle.

8. the razor of claim 6 wherein said hinge comprises at least two spaced flexible elements.

9. The razor of claim 6 wherein said hinge comprises a thin web.

10. The razor of claim 6 wherein said hinge comprises a corrugated configuration in cross-section.

* * * * *